United States Patent [19]

Färber

[11] 4,429,828

[45] Feb. 7, 1984

[54] BEVERAGE PACKAGE

[75] Inventor: Jürgen Färber, Kaarst, Fed. Rep. of Germany

[73] Assignee: PLK Papier- und Kunstoff Werke Linnich GmbH, Dusseldorf, Fed. Rep. of Germany

[21] Appl. No.: 306,107

[22] Filed: Sep. 28, 1981

[30] Foreign Application Priority Data

Oct. 4, 1980 [DE] Fed. Rep. of Germany ..... 3037657

[51] Int. Cl.[3] ..... B65D 17/28; B65D 17/42

[52] U.S. Cl. ..... 229/75; 206/634; 426/122

[58] Field of Search ..... 206/601, 604, 634, 217; 229/7 R, 7 S; 220/90.2, 90.4, 254; 215/1 A; 426/122

[56] References Cited

U.S. PATENT DOCUMENTS 3,404,988 10/1968 Rausing ..... 206/634

FOREIGN PATENT DOCUMENTS 1222847 6/1960 France ..... 229/7 S

*Primary Examiner*—George E. Lowrance
*Assistant Examiner*—Jimmy G. Foster
*Attorney, Agent, or Firm*—Sprung, Horn, Kramer & Woods

[57] ABSTRACT

In a plastic-coated cardboard milk or like container with a weakened area through which a straw is to be inserted, a pair of weakened lines surrounding such area on the inside and outside of the container respectively, the area enclosed by the line on the outside being smaller than the area enclosed by the line on the inside. This facilitates opening while resisting accidental opening under pressure from the inside.

3 Claims, 4 Drawing Figures

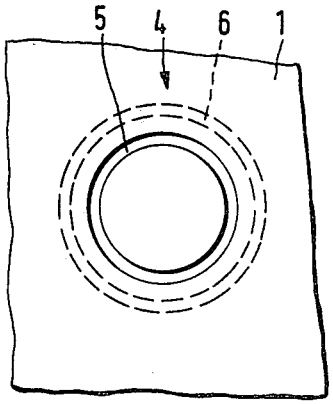
FIG.1
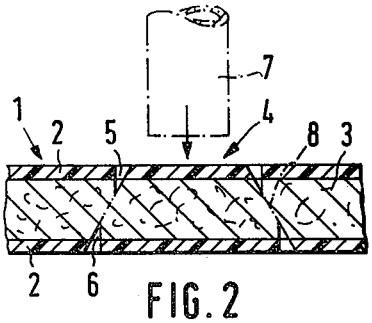
FIG. 2
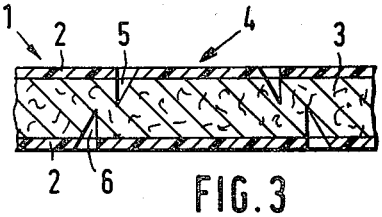
FIG. 3
FIG. 4
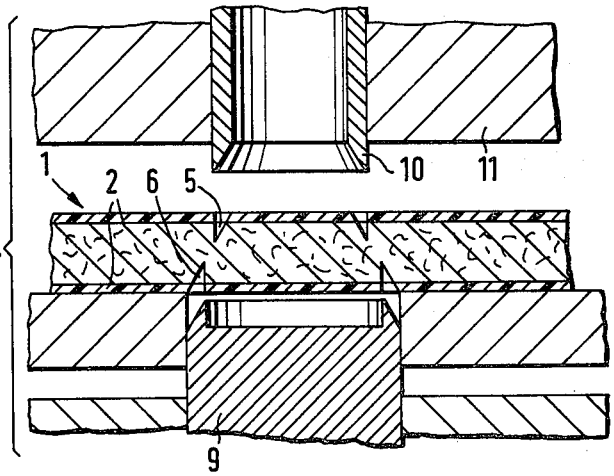

BEVERAGE PACKAGE

The invention concerns a beverage package that is made of cardboard covered on one or both sides with plastic and that has a wall that is weakened by perforation of stamping at the point where a drinking straw is to be inserted.

When the contents of a cardboard beverage package are to be drunk with a straw, weakening the wall of the package at the point where the straw is to be inserted will facilitate penetrating it with the straw. The wall can be weakened by stamping it or perforating it to a predetermined depth, but it is generally difficult to stamp or perforate it to this depth with satisfactory precision. Cardboard walls are so thin and soft that it is hard to cut them to just the right depth. The incision is often so deep on the one hand that it allows the liquid contents to leak through or, on the other, not deep enough, so that the straw will bend in two as it seeks to penetrate the wall.

The purpose of the present invention is to create a beverage package with a straw-insertion point that will reliably seal the package until the time when its contents are to be drunk and will then permit the straw ready access.

To accomplish this purpose in accordance with the invention it is proposed that the insertion point be surrounded by concentric incisions on both sides of the wall, with the area enclosed by the incision on the outside of the package being smaller than that enclosed by the incision on the inside.

It is practical for these incisions on the inside and outside of the package at the straw-insertion point to be circular. The diameter of the circular incision on the inside will be longer than that of the one on the outside. This design will facilitate punching through the area enclosed by the incisions with a drinking straw from outside. When pressure is applied from inside, however, the edge of the area enclosed by the inside incision will be forced against the edge of the area enclosed by the outside incision. The resulting counterforce will practically prevent accidental opening of the package at this point.

The invention will be especially useful on packages made of cardboard coated on both sides with plastic. The incisions need then be made only through the outside and inside coats of plastic and not into the cardboard. When the wall is pierced, the straw will only have to rip through the fibers of paper and not have to penetrate the relatively tougher layers of plastic. This will be much easier.

Arranging the incisions concentrically inside and outside the package will also avoid cutting through the wall completely and permitting the contents to leak out.

The package will be easiest to open when the incisions penetrate deeper than half the thickness of the wall. Not only the plastic layers but also the fibers of paper along the incision will then be cut through. This will facilitate piercing the wall because the fibers will not have to be ripped but only separated in the plane.

The invention will now be explained in detail with reference to the drawings.

FIG. 1 is a large-scale view of the straw-penetration point,

FIG. 2 a section through one embodiment of the invention,

FIG. 3 another embodiment, and

FIG. 4 a longitudinal section through a stamping tool used to produce incisions at the straw-penetration point.

The wall 1 of a beverage package consists of cardboard 3 coated on both sides with plastic 2. There is circular incision 5 on the outside and a circular incision 6 on the inside of the wall at the point 4 where a drinking straw is to be inserted. Inside incision 6 encloses a larger area of the wall than outside incision 5. Both incisions are concentric. Although incisions 5 and 6 can also be polygonal or oval, a circle is the simplest and hence most practical shape.

As FIG. 2 shows, it will be practical for incisions 5 and 6 to be deep enough to completely penetrate plastic layers 2 on both sides of cardboard 3. This will facilitate breaking through wall 1 with a drinking straw 7 along the separation interface 8 that extends from the bottom of incision 5 to the bottom of incision 6 and that is represented by the dotted line.

As FIG. 3 shows, incisions 5 and 6 can also penetrate deeper than half the thickness of wall 1. This means that no longitudinal fibers will have to be ripped through, only parallel fibers, when the wall is penetrated.

The stamping tool employed for cutting incisions 5 and 6 consists, as shown in FIG. 4, of a hollow lower punch 9 and of a hollow upper punch 10, which has a shorter diameter and which is mounted in an upper die 11 that can be raised and lowered. After the incision has been made, punches 9 and 10 can be lowered and raised to permit the web of packaging material to travel on.

I claim:

1. In a cardboard container plastic coated on at least one of its inside and outside and provided with a weakened area through which a straw is to be inserted, the improvement which comprises a pair of incisions penetrating deeper than half the thickness of the container and surrounding such area on the inside and outside of the container respectively, the area enclosed by the incision on the outside being smaller than the area enclosed by the incision on the inside.

2. A container according to claim 1, wherein such incisions are concentric.

3. A container according to claim 1, wherein such incisions are concentric circles.

* * * * *